United States Patent [19]

Veilleux

[11] Patent Number: 4,809,955

[45] Date of Patent: Mar. 7, 1989

[54] FENCE OR RAILING

[76] Inventor: Clement Veilleux, P.O. Box 685, St Basile le Grand, Quebec, Canada, J0L 1S0

[21] Appl. No.: 190,902

[22] Filed: May 6, 1988

[51] Int. Cl.[4] ..... E04H 17/14

[52] U.S. Cl. ..... 256/65; 256/59; 256/19

[58] Field of Search ..... 256/65, 66, 59, 19

[56] References Cited

U.S. PATENT DOCUMENTS

| | | | |
|---|---|---|---|
| 3,083,951 | 4/1963 | Huret | 256/65 |
| 4,346,872 | 8/1982 | Toruya | 256/65 |
| 4,586,697 | 5/1986 | Tornya . | |
| 4,623,128 | 11/1986 | Dutch et al. | 256/65 |

FOREIGN PATENT DOCUMENTS

| | | |
|---|---|---|
| 878854 | 8/1971 | Canada . |
| 886862 | 11/1971 | Canada . |
| 1017183 | 9/1977 | Canada . |

*Primary Examiner*—Andrew V. Kundrat

*Attorney, Agent, or Firm*—Edwin E. Greigg

[57] ABSTRACT

A fence or railing is disclosed which comprises a generally square vertical post formed, along each outer wall, with a U-shaped channel running its full length; the sidewalls of the channels defining two guide slots and the post further having a non-circular central open-ended bore. This central bore slidably and snugly receives, at its lower end, a pedestal which is fixed to a base plate. Mounted on the post is one end of an area-separation section made up of a top and a bottom horizontal rail interconnected by spaced vertical struts. The ends of the rails are inserted into one of the post channels and kept apart by flat spacer elements of identical constant cross-sections and lateral wings slid in the guide slots of the post channel. One spacer element keeps the bottom rail away from the base plate while a second spacer element separates the two rails from one another. The spacer elements have an outer face which is flush with the outer wall of the post having the channel into which the rail ends are inserted.

18 Claims, 4 Drawing Sheets

FENCE OR RAILING

BACKGROUND OF THE INVENTION

1. Field of the Invention

The present invention relates to an improved fence or railing to be made on an industrial basis. Where it serves as a fence, the latter restricts entry into a piece of land or separates one piece of land from another. The invention may also serve as a railing fixed to a balcony or the like.

2. Description of the Prior Art

Fences or railings of the type with which the invention is concerned are both functional and ornamental; their elements being made of extruded plastic material. A fence or railing comprises two major components: the posts and the area-separation or guard sections; each section being essentially formed of a top and of a bottom rail separated by vertical struts; the ends of the rails being connected to two posts. A post, on the other end, may be an end post with only one area-separation section attached to it; a line post with two sections in alignment; a corner post with two and up to four sections successively at right angles and a plain post with no section attached and serving to hinge a gate, making a total of six different types of posts to meet all situations.

An industrial problem involved with present day fence or railing constructions, apart from the large number of different posts required, is broadly that specialized machinery must be used to prepare at least the major components: the posts and the horizontal top and bottom rails. Also, when prepared for one particular installation, the components cannot be changed or altered to meet the requirements of another installation. This condition leads to high costs in manufacturing, in repair work and in inventory.

In the case of the posts, for instance, holes are to be made through their sides at precise locations to receive the ends of the rails of the area-separating sections. A post cannot therefore be changed to fit another situation where the rails are distanced differently and/or are provided on different numbers of sides of the posts. It will be remembered, in this latter regard, that six different types of posts must presently be stored to meet all requirements, as mentioned above.

Additionally, posts now used are essentially plain square plastic hollow tubes which have to be reinforced by pouring concrete into them at least up to a certain height embedding, by the same token, the ends of the bottom rails, so that if changes have to be made to the fence or railing, involving displacement of the rails, the fence or railing has to be completely dismantled and the posts and rails irreperably damaged.

As to the rails of the area-separating sections or guard sections, two different types are used.

In one case, where they are essentially plain square plastic hollow tubes, as the posts, holes have likewise to be made into them, using specialized machinery, and the vertical struts slid directly into them. This construction provides the struts with a high degree of solidity as they are securely held, by their ends, inside the hollow rails. However, the method prevents easy modification of the strut arrangement when the assembly is completed.

To avoid this drawback, channels have been secured to one face of the rectangular rails; the struts fitting into these channels and being kept apart by spacing inserts slidably fitting into guiding slots pre-formed along the legs of the channels. This method of construction permits easy modification of the strut arrangement but the latter is substantially weaker than in the above case because if a sufficiently strong lateral pressure is applied to the struts, they will bend out, twist the rails and even pop out of the channels.

In both cases, strengthening of the rails has been attempted by inserting metal channels into them. But being unprotected from rain water, the rails tend to crack during winter as the plastic and metal expand and contract at different rates due to freezing and thawing.

SUMMARY OF THE INVENTION

A general object of the present invention therefore lies in providing a fence or railing capable of alleviating the difficulties mentioned above, particularly facilitating modification or expansion and also easing assembly.

Another important object is to reduce the number of the different posts, mentioned above, to a single universal post, thus lowering manufacturing and inventory costs. By its particular strong construction, as will be seen hereinafter, this new universal post makes it possible to eliminate reinforcing steel rods and concrete that are now used.

Another object still is that, with the new universal post, modifications or changes in the top and bottom rails can be achieved with a minimum of labor and without damage to the post or to the rails. Furthermore, these objects are attained without effecting the decorative appearance of the fence where the posts, in particular, retain a smooth outer finish.

More specifically, the invention broadly resides in a fence or railing which essentially comprises a generally square vertical post formed, along each outer wall, with a U-shaped channel running its full length; the sidewalls of the channels defining two guide slots and the post further having a non-circular central open-ended bore. This central bore slidably and snugly receives, at its lower end, a pedestal which is fixed to a base plate. Mounted on the post is one end of an area-separation section made up of a top and a bottom horizontal rail interconnected by spaced vertical struts. The ends of the rails are inserted into one of the post channels and kept apart by flat spacer elements of identical constant cross-sections and lateral wings slid in the guide slots of the post channel. One spacer element keeps the bottom rail away from the base plate while a second spacer element separates the two rails from one another. The spacer elements have an outer face which is flush with the outer wall of the post having the channel into which the rail ends are inserted.

According to a particular aspect of the invention where the post carries only one area-separation section; further spacer elements are provided that are slid in the guide slots of the remaining channels, these further elements extending the full length of the channels to act as masking elements. Where further area-separating sections are mounted on the post, in the same manner as described above, other masking elements are provided to hide the remaining non-used channels, if any are left.

Preferably, for each area-separation section, a further spacer element rests on and above the top rail; the post then having a cap removably mounted at its top.

A search of the prior art has been made which has revealed: U.S. Pat. No. 4,586,697 of 1986; Canadian Pat. Nos. 878,854 of 1971; 886,862 of 1971 and 1,017,183 of 1977. These patents indicate that the problems mentioned above are known and they propose solutions for solving them. None of these however propose a structural arrangement as effective and cost conscious as the arrangement disclosed herein, particularly the use of a universal post apt to be used with all kinds of fence or railing structures.

The description of a preferred embodiment now follows that will provide further features and advantages of the invention; the description referring to the appended drawings.

BRIEF DESCRIPTION OF THE DRAWINGS

FIG. 1 is an exploded perspective view of one end of a fence or railing incorporating the improvements of the invention;

DESCRIPTION OF THE PREFERRED EMBODIMENT

Figure 7:
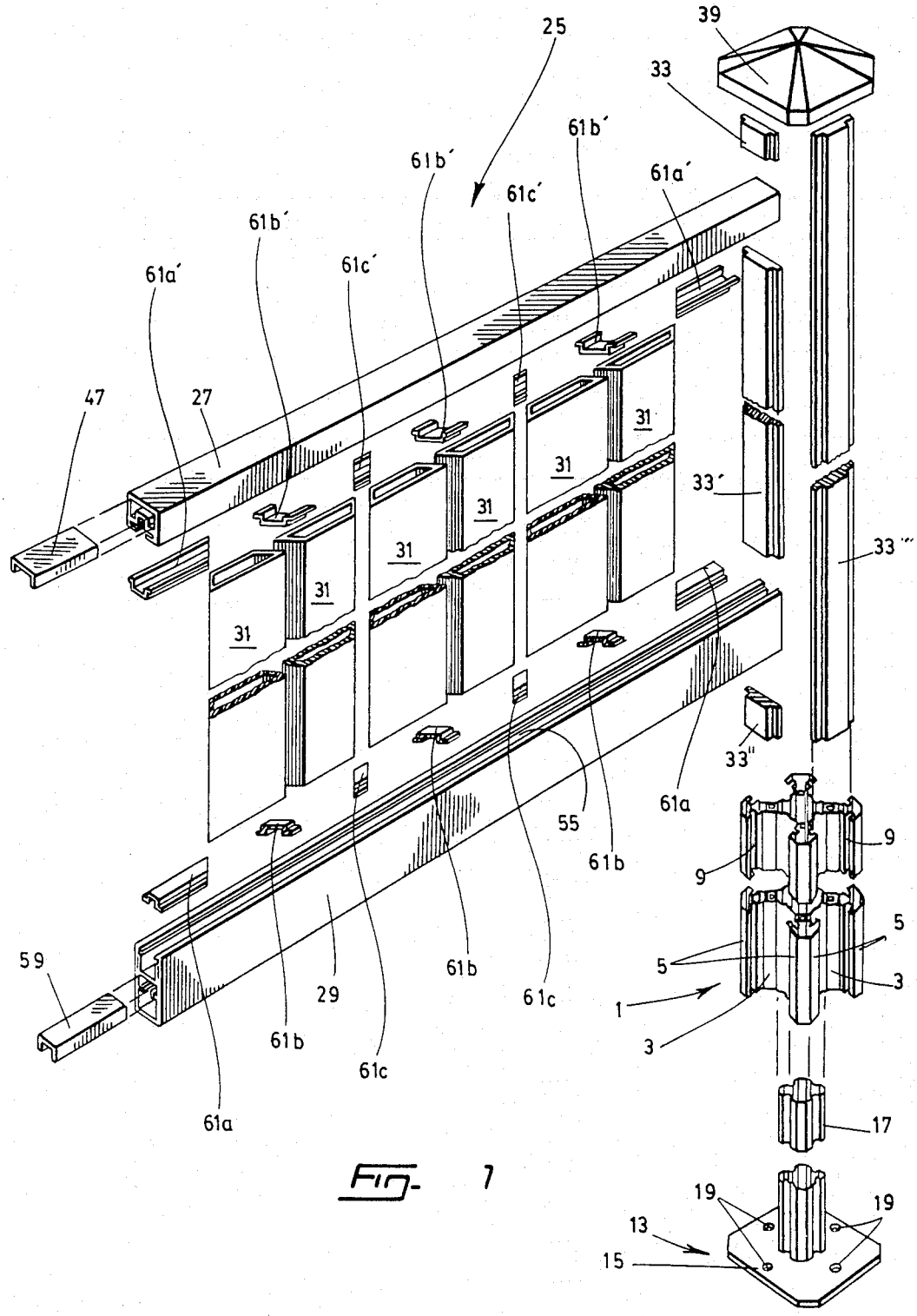
FIGS. 5 to 8 are cross-sectional views respectively of the bottom rail; the top rail; a spacer element and a distance-piece.

Referring to the drawings, the post 1 is a one-piece elongated body made of extruded plastic material and having an essentially rectangular, preferably square, constant cross-section throughout its length. It is formed with inwardly directed U-shaped open-ended channels 3 along the full length of its outer walls 5. Each channel has sidewalls 7 defining two guide slots 9 facing one another and extending the full length of the post outer walls 5. The post also has a non-circular, preferably square, central bore 11.

Post 1 is mounted on a support base 13 comprising a flat plate 15 and a pedestal 17 fixed to the plate and upstanding from it. The pedestal 17 has a non-circular cross-sectional shape like that of the central bore 11 so that it snugly fits into the post lower end without -rotation; the post being fixed to the pedestal by self-tapping screws through the tube defining the central bore 11 at the bottom of the channel 3. The base plate 15 is pierced with a set of holes 19 around the stem 17 through which holes may extend the threaded ends of bolts (not shown) of which the other ends are sunk in the concrete of a foundation block (not shown). In this manner, the base 13 may solidly be secured to the ground to keep the post 1 upright.

In the case of a veranda railing or the like, the bolts may extend through the veranda floor.

Figure 3:
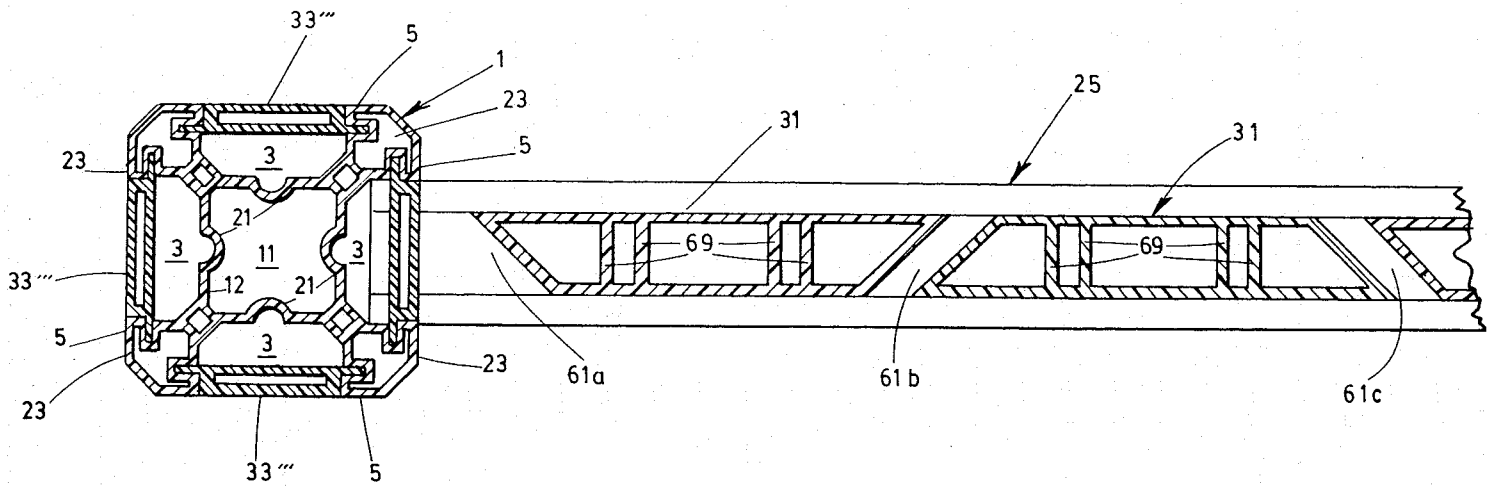
FIG. 3 is a longitudinal cross-sectional view taken at mid-height of the fence or railing.
Figure 4:
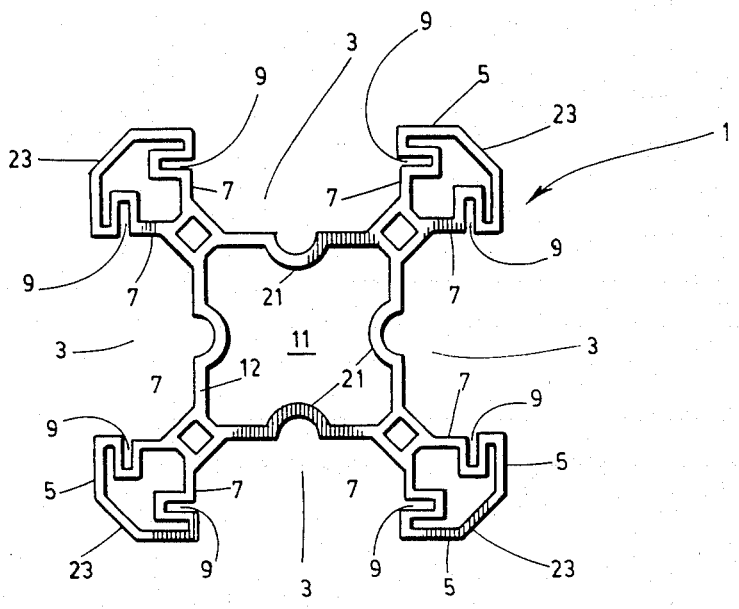
FIG. 4 is a transverse cross-sectional view of a post.

For sturdier support of the post, the base plate 15 and the pedestal 17 may be made of metal, such as aluminum. For a similar reason of strength, the central tubular part 12 of the post that defines the bore 11 should be reinforced by inwardly directed arcuate ribs 21 also running the full length of the bore. As best shown in FIGS. 3 and 4, the post 1 outside the bore 11 and outside the channel 3 forms four like corner members 23 which may be hollowed out without impairing the strength of the post but making it lighter. As seen, these hollow corner members 23 radiate from the corners of the square central tubular part 12 and define the post outer walls 5. The latter may have chamfered corners for decorative purposes.

The width of the channels 3 should be about at least one third that of the outer walls 5 of the post.

With a somewhat cellular post construction of uniform generally outwardly square cross-section, as described above, it has been found that no concrete need be poured in its bore 11; the post being much stronger by its particular configuration than the standard post of plain rectangular cross-section.

Figure 2:
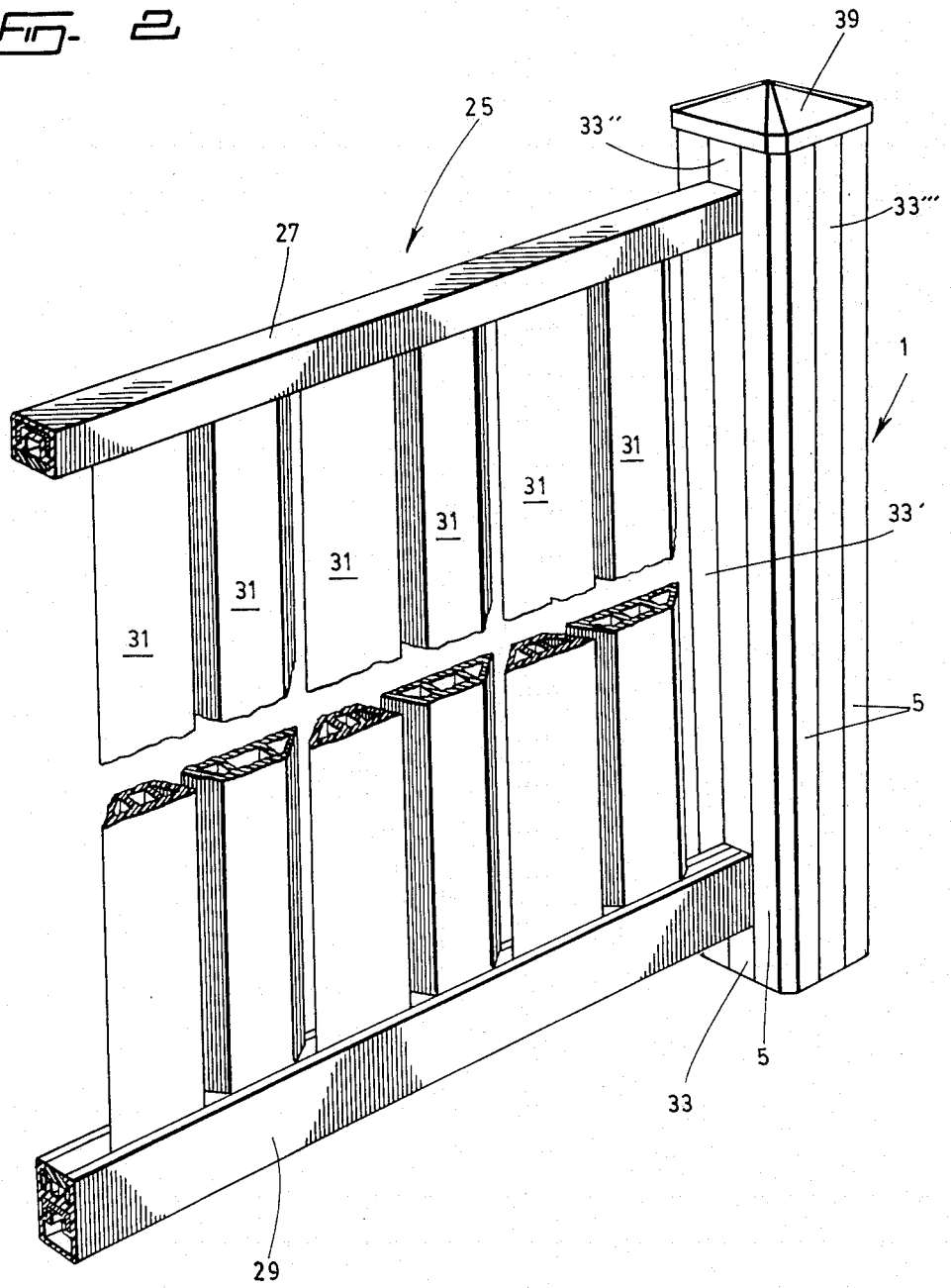
FIG. 2 if a view similar to that of FIG. 1 but showing the fence or railing in assembled condition.

FIGS. 1, 2 and 3 show only one end of one area-separation or guard section 25 secured to the post 1. It will be appreciated however that mounting of the other end of the section 25 to another post like post 1 is obtained in identical manner. The mounting is by insertion of the other ends of the top and bottom rails 27, 29, into one of the channels 3 of the other post.

Again, it will be appreciated that further identical guard sections 25 (not shown) can, in the same manner, be mounted in the other channels 3.

The two rails 27, 29, are interconnected by vertical struts 31, as said before.

As is readily apparent, the post 1 may accommodate up to four area-separation sections 25. Because of its uniform cross-section, it may be manufactured in indefinite lengths and cut down to the required lengths at the factory or on the site without the use of specialized machinery. This considerably reduces inventory as well as highly facilitating adaptation of the posts to various uses.

The two rails 27, 29, of the section 25 are held in the desired spatial relationship along the post 1 by means of essentially flat spacer elements 33, 33', 33'', identical in cross-sections, which cross-section is shown in FIG. 7. As illustrated, a spacer element comprises a hollow rectangular body 35 and lateral wings 37 that outwardly extend in the plane of one side only of the body 35. These wings 37 are slidably inserted in the guide slots 9. As shown, the spacer element 33 is comprised between the base 15 and the bottom rail 29, supporting it and resting on the base plate 15; the spacer element 33' is comprised between the two rails, resting on the bottom rail 29 and supporting the top rail 27, and the spacer element 33'' resting on and above the top rail 27.

The thickness of the spacer elements is selected such that their outer faces fall flush with the post outer wall 5 having the channel 3 into which the rails are slid so that the spacer elements serve to mask the said channel 3 between the rails, as shown in FIG. 2.

Where the post 1 is an end post with only one area-separation or guard section 25 attached to it, the remaining three unused channels 3 are closed or masked by three further spacer elements 33''' slid into the groove slots 9 of the unused channels, extending the full length of the post, as shown in FIGS. 2 and 3.

Similarly, if more than one and less than four sections 25 are attached, the unused channel or channels 3 are masked by a spacer element or elements 33'''.

In the end post installation of FIG. 2, the post 1 is topped by a removably mounted cap 39 secured to it by self-tapping screws through the cap's skirt and through the post outer walls 5.

Figure 6:
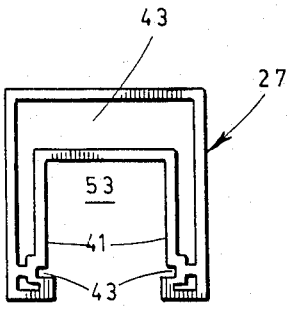
Figure 7:
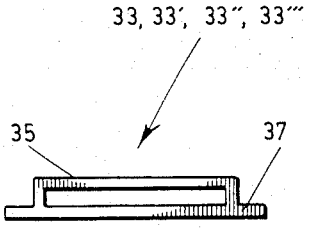

The horizontal top rail 27, as shown in FIGS. 1 and 6, is a downwardly turned U-shaped member of uniform cross-section throughout its length, having inner side flanges 41 provided with guide slots 43 facing one another and extending the full length of the rail. It is also double-walled thereby defining a channel-shaped housing 43 into which is lodged an inverted steel reinforcement channel 47 (FIG. 1) covering the full distance between the two posts holding the guard section 25.

Figure 5:
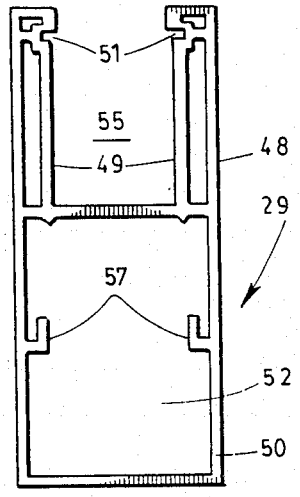

The bottom rail 29 (FIGS. 1 and 5), on the other hand, has an upright U-shaped portion 48 of constant cross-section throughout its length with reinforcing double-walled side flanges of which the upper ends of the inner flanges 49 are formed with guide slots 51.

Depending from the portion 48 is a closing framework 50 defining a reinforcement housing 52 extending along the full length of the bottom rail 29. At mid-height of the housing, are two upturned brackets 57 receiving the flanges of an inverted reinforcing metal channel 59 (FIG. 1) covering the full distance between the two posts holding the guard section 25.

The open end of the chamber 53 of the top rail 27 and the open end of the chamber 55 of the bottom rail 48 face one another so that the aforementioned struts 31 may be slidably received into the said chambers 53, 55.

Figure 8:
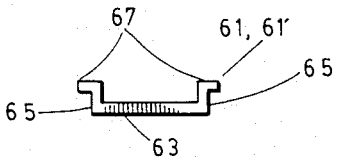

The struts 31 are held apart in the rails 27, 29, by essentially flat distance-pieces 61, 61', all having the same cross-section which is shown in FIG. 8. The distance-pieces are U-shaped with a central web 63 and lateral flanges 65 provided at their free ends with outwardly turned wings 67.

Referring to FIGS. 1 and 3, it is seen that the struts 31 are of identical cross-configuration, having the shape of hollow isosceles trapezia with inclined sides extending across the chambers 53, 55, of the rails 27, 29, respectively. Reinforcing ribs 69 are provided in the hollow struts, spanning their full length. The sides of the struts 31 are preferably inclined at 45°. It will be noted that consecutive struts 31 are inverted with respect to the inclined sides so that inclined sides of successive struts are parallel and, by properly sizing the length of the distance-pieces 61, 61', the struts overlap.

As shown in FIG. 1, the distance-piece sections **61*a*, 61*b* and 61*c*; 61*a*, 61*b'* and 61*c* ' are cut across at appropriate angles to fit between successive struts 31 and between the end struts and the posts 1. The same requirement prevails for both the distance-pieces of which the wings 67 are slid in the guide slots 51 of the bottom rail 29 and the distance-pieces of which the wing 67 are slid in the guide slots 43 of the top rail 27**.

It may be pointed out that, similarly to the post 1 and spacer elements 33 to 33''', the rails 27, 29, the struts 31 and the distance-pieces 61 may advantageously be manufactured in indefinite lengths and cut down to the required lengths, and transversely cut in the case of the distance-piece sections, at the factory or at the construction site. This is because the post 1, the spacer elements 33 to 33''', the rails 27, 29, the struts 31 and the distance-pieces 61 are of constant cross-section throughout their length.

The assembly may be resumed as follows, taking as an example the end post installation shown in FIGS. 1 and 2.

After the support base 13 has been solidly anchored to the concrete support or to the floor of a balcony, the post 1 is slid over the pedestal 17 and the two secured together by self-tapping screws. The spacer element 33 is then slid along the guide slots 9 of one channel 3 right down to the base plate 15. One end of the bottom rail 29 is simply entered into the same channel 3 until it reaches its bottom, resting on the top of the spacer element 33. Similarly to the spacer element 33, the space element 33' is slid along the post 1 in the same guide slots 9 until it seats on the bottom rail 29. The ends of the struts 31 are thereafter inserted into the chambers 53 and 55 of the rails 27 and 29 with appropriate introduction of the distance-pieces 61, 61', between them; the end of the top rail 27 being simultaneously shifted inside the channel 3. Then follows the insertion, along the guide slots 9 of the channel 3, the spacer elements 33''. After the remaining unused channels 3 have been masked by the longer spacer elements 33''', the cap 39 is placed over the top of the post 1 and screwed to it by self-tapping screws. The same operations simultaneously take place with respect to the other post to which the other end of the guard section 25 is mounted.

It will be realized that, with this construction, any repair, replacement or other changes that are desired may easily be carried out simply by removing the cap and sliding the fence or railing components out one by one since none of the pieces are fixed. It will be noted also, particularly from FIG. 2, that the construction does not impair in any way the decorative aspect of the fence or railing, especially the post.

I claim:

1. A fence or railing comprising:

an elongated vertical post, of essentially rectangular constant cross-section, made in one piece of extruded plastic material and formed, along the full length of each of the outer walls thereof, with an inwardly directed U-shaped channel having sidewalls defining two guide slots facing one another and extending the full length of said sidewalls; said post further having a central open-ended bore of non-circular cross-section;

a support base comprising a flat plate and a pedestal upstanding from said plate, said pedestal having a non-circular cross-section like that of said post central bore and snugly fitting non-rotatably into the lower end of said bore;

at least one area-separation section comprising horizontal top and bottom rails interconnected by vertical struts, wherein common ends of said rails are slidably inserted into one of said post channels;

essentially flat spacer elements having identical constant cross-sections including outwardly projecting lateral wings slidably inserted in said guide slots of said one of said post channels, said spacer elements comprising:

a first spacer element between said base plate and said bottom rail, supporting said bottom rail and resting on said base plate;

a second spacer element between said two rails, supporting said top rail, and resting on said bottom rail, and wherein said spacer elements have an outer face falling flush with the outer wall of said post having said one channel to act as masking elements for said one channel.

2. A fence or railing as claimed in claim 1, comprising:

at least one further area-separation section mounted in a further one of said post channels in the manner set forth in said claim 1, with respect to said at least one area-separation section, and further spacer elements slid in the guide slots of the remaining channels and extending the full length of said slots, said further spacer elements acting as masking elements for said remaining channels.

3. A fence or railing as claimed in claim 1, comprising further spacer elements, each further spacer element being slid in the guide slots of one of the remaining channels, said further spacer elements extending the full length of said guide slots and acting as masking elements for said remaining channels.

4. A fence or railing as claimed in claim 1, wherein said spacer elements further comprise a third spacer element resting on and above said top rail, and including a cap removably mounted over the top of said post, said cap extending down to said third spacer element.

5. A fence or railing as claimed in claim 3, wherein said post, outside said central bore and outside said channels, is hollowed out and wherein said base plate is pierced with holes around said pedestal and within the boundary defined by the outer walls of said post and by said spacer elements.

6. A fence or railing as claimed in claim 1, wherein each of said spacer elements comprises a hollow rectangular body and said lateral wings extend in the plane of one side only of said body.

7. A fence or railing as claimed in claim 2, wherein each of said spacer elements comprises a hollow rectangular body and said lateral wings extend in the plane of one side only of said body.

8. A fence or railing as claimed in claim 3, wherein each of said spacer elements comprises a hollow rectangular body and said lateral wings extend in the plane of one side only of said body.

9. A fence or railing as claimed in claim 1, wherein:

said horizontal top and bottom rails comprise elongated U-shaped members of constant cross-sections defining chambers open at one end and having sidewalls provided with guide slots facing one another and extending the full length of said rails; the open ends of said chambers facing one another and said chambers receiving the ends of said vertical struts;

said struts are held apart by essentially flat distance-pieces having identical constant cross-sections and including outwardly projecting lateral wings slidably inserted in said rail inward guide slots.

10. A fence or railing as claimed in claim 9, wherein said distance-pieces are U-shaped in cross-section with a central web and lateral flanges, said wings being provided at the free ends of said flanges and said web having an outer face falling flush with the free ends of said rail U-shaped members.

11. A fence or railing as claimed in claim 10, wherein said top rail U-shaped member is double-walled thereby defining a channel-shaped housing and wherein said fence or railing further comprises a reinforcement metal channel lodged in said housing.

12. A fence or railing as claimed in claim 10, wherein said bottom rail U-shaped member comprises: double-walled side flanges; means depending from said side flanges and defining a reinforcement housing extending the full length of said bottom rail, and a reinforcement metal channel lodged in said reinforcement housing.

13. A fence or railing as claimed in claim 1, comprising three further area-separation sections each mounted in one of the remaining post channels in the manner set forth in said claim 1 with respect to said at least one area-separation section.

14. A fence or railing as claimed in claim 9, wherein each vertical strut has, in cross-section, the shape of a hollow isosceles trapezium with inclined sides extending across said chambers of said rails; consecutive struts being inverted with respect to said inclined sides.

15. A fence or railing as claimed in claim 14, wherein said distance-pieces between said struts are cut across at the same angle as said inclined sides of said struts.

16. A fence or railing as claimed in claim 15, wherein said angle is 45°.

17. A fence or railing as claimed in claim 14, further comprising reinforcing ribs in said hollow vertical struts spanning the full length thereof.

18. A fence or railing as claimed in claim 1, wherein the width of said U-shaped channels is about at least $\frac{1}{3}$ that of the outer walls of said post.

* * * * *